US005138541A

United States Patent [19]

Kano

[11] Patent Number: 5,138,541

[45] Date of Patent: Aug. 11, 1992

[54] LAMP WITH VENTILATED HOUSING

[75] Inventor: Tetsuhiro Kano, Bamberg, Fed. Rep. of Germany

[73] Assignee: NAFA-Light Kurt Maurer, Zumikon, Switzerland

[21] Appl. No.: 818,733

[22] Filed: Jan. 6, 1992

Related U.S. Application Data

[63] Continuation of Ser. No. 629,216, Dec. 18, 1990, abandoned.

[30] Foreign Application Priority Data

Mar. 14, 1990 [DE] Fed. Rep. of Germany ..... 4008124

[51] Int. Cl.[5] ..... F21V 7/20

[52] U.S. Cl. ..... 362/345; 362/293; 362/294; 362/373

[58] Field of Search ..... 362/293, 294, 345, 373, 362/297, 804

[56] References Cited

U.S. PATENT DOCUMENTS

| | | | |
|---|---|---|---|
| 3,255,345 | 6/1966 | Chadwick | 362/218 |
| 3,381,125 | 4/1968 | Cooper | 362/263 |
| 3,560,728 | 2/1971 | Atkin | 362/294 |
| 4,032,771 | 6/1977 | Ilzig | 362/294 X |
| 4,135,231 | 1/1979 | Fisker | 362/297 X |
| 4,695,930 | 9/1987 | Wierzbicki et al. | 362/294 X |

FOREIGN PATENT DOCUMENTS

| | | |
|---|---|---|
| 3339789 | 5/1985 | Fed. Rep. of Germany . |
| 1454815 | 4/1966 | France . |
| 0138726 | 1/1937 | Switzerland . |

*Primary Examiner*—Stephen F. Husar
*Attorney, Agent, or Firm*—Michael N. Meller

[57] ABSTRACT

In a lamp (10) equipped with a cold-light reflector (18) behind the cold-light reflector (18) a further reflector (32) is provided which reflects the infrared radiation onto a housing wall (14) of the lamp (10).

3 Claims, 1 Drawing Sheet

LAMP WITH VENTILATED HOUSING

Figure 2:
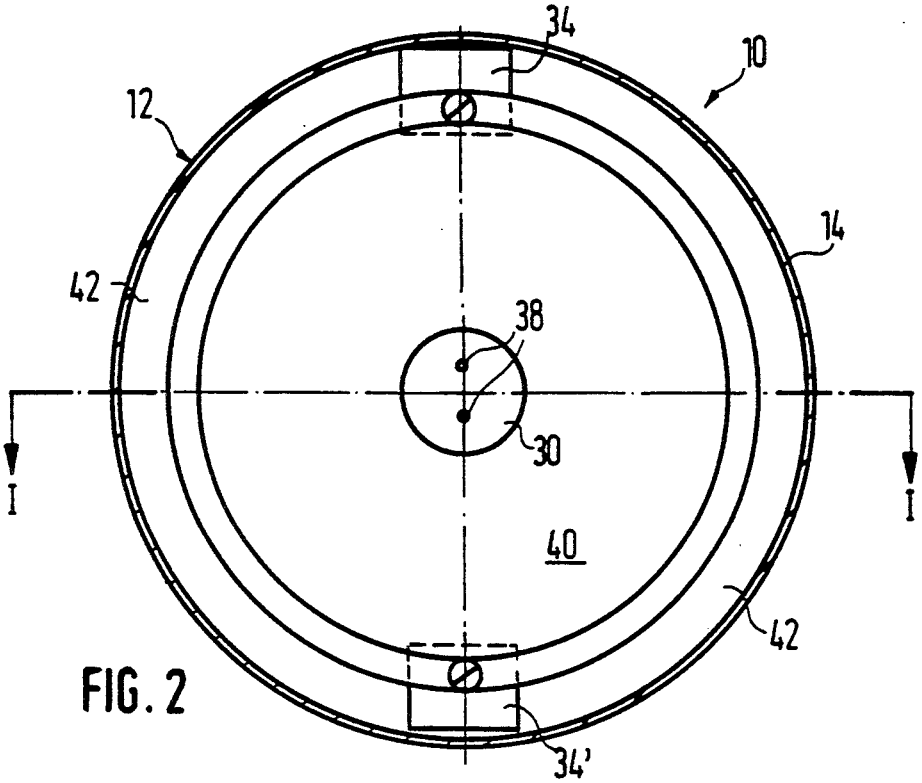

This application is a continuation, of application Ser. No. 629216, filed Dec. 18, 1990, now abandoned.

The invention relates to a lamp, light or lighting fitting comprising a housing in which a cold-light reflector and a socket for a light source are arranged.

Cold-light reflectors, known per se, reflect light in the visible range of the electromagnetic spectrum, in particular at higher wavelengths, but transmit infrared radiation. Such cold-light reflectors are used in lighting fittings and lamps for technical and esthetic reasons. With the cold-light reflector illumination radiation is generated from which the infrared (and possibly also red) radiation components are removed. This achieves a specific esthetic effect. Technically, the use of cold-light reflectors has among other things the effect that due to the lack of infrared components, the radiation generated by the lamp does not cause any undesired heating up of the illuminated object.

In particular when using incandescent bulbs, for example halogen bulbs, very considerable amounts of infrared radiation are generated (Planckian radiator). A light fitting or lamp provided with a cold-light reflector thus reflects only visible radiation forwardly in the radiating direction of the lamp whereas infrared rays are allowed by the cold-light reflector to pass through rearwardly.

If the cold-light reflector is incorporated into a housing the infrared radiation is irradiated into the housing. Problems arise in the housing due to the undesirable generation of heat.

This concerns in particular also the mounting of the incandescent bulb which is generally so arranged that its coil is located at the focal point of the cold-light reflector. The so-called squeeze point of the incandescent bulb (its neck) is located in the region of the reflector neck.

The temperature at the neck of the incandescent bulb should remain below a predetermined limit value. If the temperature exceeds certain limit values the lamp has only a short life. For example, with an incandescent bulb with a nominal mean life of 2000 hours the limit value is 350° C.

The use of a cold-light reflector in a lamp can lead to an increase of the temperatures in the housing of the lamp in so far as infrared radiation passes rearwardly through the cold-light reflector. The problem of excessive heating in the interior of the housing arises in particular when the incandescent lamp has a power requirement of more than 50 W.

The problem of heat development is critical in particular when the incandescent bulb is inserted in a hanging position (vertical). In such a case the neck is directly above the incandescent bulb.

It is possible to provide the housing of the lamp with openings such as holes or slits. However, a cold-light reflector does not only allow the infrared radiation to pass but also a visible part of the electromagnetic spectrum (in particular in the red range). This light is irradiated outwardly through said openings and has a disturbing effect. Also, the openings detract from the appearance of the lamp.

The problem underlying the invention is to improve a lamp of the type set forth at the beginning so that in simple manner a relatively low temperature is produced in the interior of the housing of the lamp and in particular at the so-called squeeze point or constriction of the incandescent bulb, and the lamp has an overall appealing esthetic form.

This problem is solved according to the invention in that behind the cold-light reflector a further reflector reflecting at least infrared radiation is arranged in such a manner that it reflects incident infrared radiation onto the inner side of the housing wall.

According to a preferred further development of the lamp according to the invention the socket of the light source is secured to the further reflector. Since the further reflector is effective only in the interior of the housing of the lamp, i.e. light reflected thereby does not pass out of the housing of the lamp, it can also be referred to as "inner reflector".

The lamp according to the invention does not require any slits, slots or holes in the housing wall.

According to a further preferred embodiment of the invention the further reflector (inner reflector) is in thermally conductive connection with the housing wall. Preferably, this thermally conductive connection is implemented by means of one or more webs which connect, and at the same time support, the inner reflector thermally conductively to the housing wall.

Furthermore, it is preferably provided that the light source or a member connected thereto projects freely through a central opening in the cold-light reflector. This results in a further flow path for air providing heat dissipation.

It is also advantageous for a good thermal dissipation from the interior of the housing that between the further reflector and the housing wall one or more openings or also an encircling free space is provided through which air can pass.

For an effective air circulation through the lamp, a further embodiment of the invention provides that the housing is equipped at the front and back with openings which are arranged preferably in the edge region of the lamp, i.e. near the cylindrical housing outer wall, so that air can enter the interior of the housing at the outside of the cold-light reflector near the outer housing wall, flow over said housing wall and then emerge from the interior of the housing in the rear region of the lamp.

For an effective heat dissipation from the housing of the lamp, in accordance with a preferred embodiment the reflection surface of the further reflector (inner reflector) has an angle of inclination less than 85° with respect to the axis of the lamp.

Figure 1:
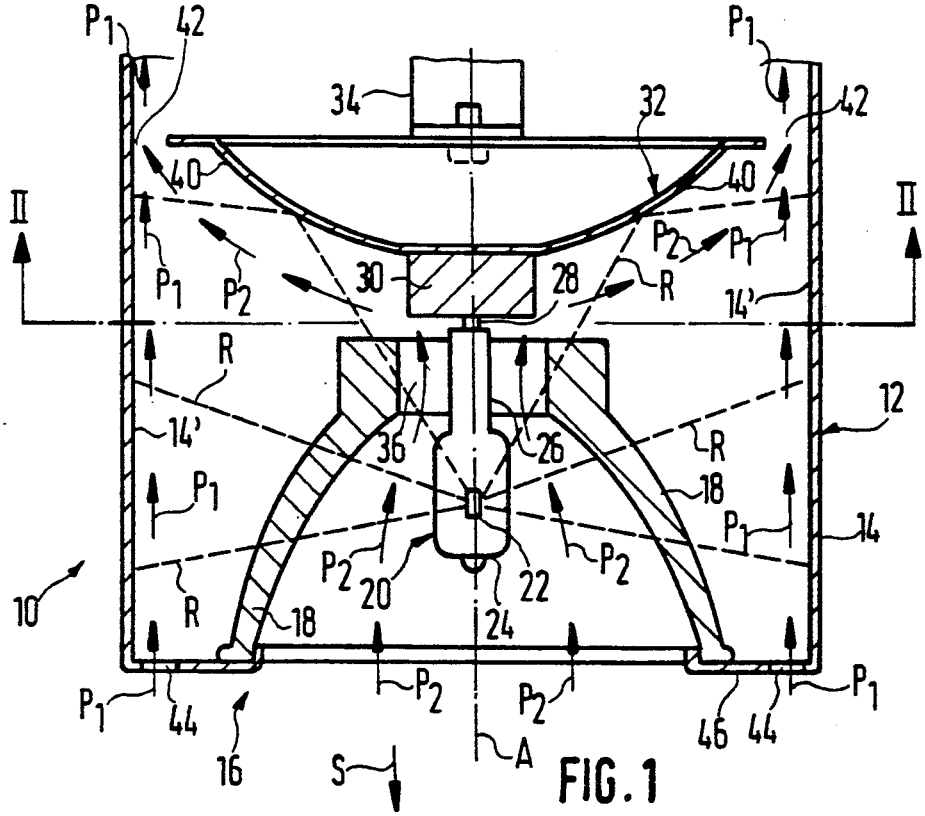

Hereinafter a preferred embodiment of the invention will be explained in detail with the aid of the drawings, wherein:

FIG. 1 shows a section in the direction of the optical axis of a lamp along the line I—I of FIG. 2 and FIG. 2 is a section perpendicular to the optical axis of the lamp along the line II—II of FIG. 1.

The lamp or light fitting 10 shown in the Figures has a housing 12 with a housing wall 14.

The front side of the lamp 10 is provided with the reference numeral 16, i.e. the radiation direction of the lamp 10 points in the direction of the arrow S. It is from this that the terms "front" and "back" used in the claims are derived.

In the housing 12 a cold-light reflector 18 is mounted. The cold-light reflector is known per se and reflects light in the visible range of the electromagnetic spectrum whereas infrared radiation (and possibly also red components of the radiation) is transmitted by the cold-light reflector 18. The infrared rays are indicated by dashed lines in FIG. 1 and denoted by the reference numeral R.

A light source 20 with a coil 22 and a glass bulb 24 is arranged so that the coil 22 is located substantially in the focal point of the cold-light reflector 18.

The light source 20 comprises a tapered neck 26 which can be secured by means of two plugs 28 to a socket 30. The two plugs or pins 28 are pushed into holes 38 in accordance with FIG. 1.

Behind the cold-light reflector 18 a further reflector 32 is disposed. The term "behind" relates to the radiation direction S of the lamp, which points forwardly. The further reflector 32 is described in detail below. Secured to it is the socket 30 so that the light source 20 and in particular the tapered neck 26 thereof is not in contact with the cold-light reflector 18 or any other member of the lamp.

As is apparent from FIG. 2 the reflector 32 is mechanically connected in thermally conductive manner to the housing wall 14 via two diametrically opposite webs 34.

In accordance with FIG. 1, in the neck of the cold-light reflector 18 an opening 36 is formed which is rotational-symmetrical with respect to the optical axis A of the lamp 10 and through which the neck 26 of the light source 20 projects centrally.

The reflection surface 40 of the infrared reflector 32 is inclined with respect to the optical axis of the lamp in such a manner that incident infrared radiation R is deflected with high efficiency to the inner surface 14' of the housing wall 14. The infrared radiation generated by the light source 20 is thus mostly conducted into the housing wall 14 which therefore takes up the greater part of the heat generated by infrared radiation. This heat is dissipated by convection. For this purpose, between the infrared reflector 32 and the housing wall 14 an opening 42 extending substantially round the entire periphery of the lamp is provided (said opening being interrupted only by the webs 34). Furthermore, also adjacent the housing wall 14, at the front side 16 of the lamp 10 in the front wall a plurality of openings 44 are provided so that air can enter in the direction of the arrow $P_1$ into the interior of the housing and flow past the housing wall 14 near the inner side 14' and then further rearwardly through the openings 42. In the rear portion of the lamp (i.e. at the end of the lamp opposite the radiation direction S according to FIG. 1 and not shown in detail in the Figure) corresponding openings are provided so that the heating air can emerge from the housing 12 in the direction of the arrow $P_1$. The air flow through the housing 12 is promoted by the configuration of the reflector 32 shown in detail in FIG. 1. Furthermore, air passes in the direction of the arrow $P_2$ through the opening of the cold-light reflector 18 at the front side 16 and flows through the opening 36 in the neck of the cold-light reflector 18 further in the direction of the arrow $P_2$. The air flows described above occur with a high convection effect particularly when the axis A of the lamp 10 is aligned vertically, i.e. the lamp irradiates downwardly and the radiation direction S is directed opposite to gravity.

The infrared reflector 32 acts not only as a mechanical socket for the light source 12 but also as cooling means for the so-called squeeze point of the light source 20. The temperature in the critical neck region of the light source remains at relatively low values although the side walls of the lamp 10 do not have any openings.

The infrared reflector 32 is so formed that the components of the infrared radiation reflected at it cannot return to the light source but are directed substantially onto the housing wall 14 of the lamp. The light source as a whole is not unnecessarily heated. The relatively cool air entering in the direction of the arrow $P_2$, on passing through the opening 36 which acts at this point like a nozzle due to the reduced opening cross-section, provides effective cooling in the critical region of the neck 26 of the light source 20.

Due to the specified inclination of the reflection surface 40 of the infrared reflector 32 with respect to the optical axis A, which is less than 75°, preferably less than 85°, the hot air rises in the direction of the arrow $P_2$ over the reflection surface 40 and passes through the openings 42 laterally of the infrared reflector 32.

The infrared reflector 32 absorbs only a small part of the thermal energy and also immediately conducts said part to the housing wall 14 directly via the webs 34, made with material having a good thermal conductivity. The housing wall 14 is cooled not only by giving off heat to the outer air but in particular also by the air stream flowing along the wall in the direction of the arrows $P_1$ and $P_2$.

Since as described the infrared reflector 32 remains relatively cold, a considerable temperature gradient arises from the light source 20 to the infrared reflector 32. Thus, heat is also dissipated with high efficiency from the neck 26 of the light source 20 into the infrared reflector 32 which in turn carries away this heat via the stirrup-shaped webs 34 to the housing wall 14, which is cooled as described in particular by convection.

A transformer (not shown) can be incorporated into the lamp in accordance with FIGS. 1 and 2. Said transformer is arranged behind the infrared reflector 32 and in particular can be secured to the webs 34. The infrared reflector 32 is made so large that the transformer cannot be seen, or only a small part thereof, from below (according to FIG. 1) even if the cold-light reflector 18 is imagined to be removed. As a result, the infrared rays cannot reach the transformer and the heated air flows through the openings 42 past the transformer without being able to heat up the latter in a disadvantageous manner.

I claim:

1. A lamp (10) comprising a housing (12) in which a cold-light reflector (18) and a socket (30) for a light source (20) are arranged, wherein viewed in radiation direction (S) of the lamp (10), behind the cold-light reflector (18) a further reflector (32) reflecting at least infrared radiation (R) is arranged in such a manner that it reflects incident infrared radiation (R) onto the inner side (14') of the housing wall (14), between the further reflector (32) and the housing wall (14) an opening (42) is provided for the passage of air, said socket (30) for the light source (20) is fixed to said further reflector (32), said light source (20) projects freely through an opening (36) of said cold-light reflector (18) such that air can flow through said opening (36) of said cold-light reflector, and wherein, viewed in the radiation direction (S) of the lamp (10), the front wall of the housing (12) comprises openings (44) for passage of air.

2. Lamp according to claim 1, wherein the further reflector (32) is in thermally conductive connection with the housing wall (14).

3. Lamp according to claim 2, wherein the further reflector (32) is in thermally conductive connection with the housing wall (14) via at least one web (34).

* * * * *